US009237640B2

(12) United States Patent
Abs et al.

(10) Patent No.: US 9,237,640 B2
(45) Date of Patent: Jan. 12, 2016

(54) RF DEVICE FOR SYNCHROCYCLOTRON

(71) Applicant: Ion Beam Applications, Louvain-la-Neuve (BE)

(72) Inventors: Michel Abs, Bossiere (BE); Jean-Claude Amelia, Erquelinnes (BE)

(73) Assignee: Ion Beam Applications, Louvain-la-Neuve (BE)

( * ) Notice: Subject to any disclaimer, the term of this patent is extended or adjusted under 35 U.S.C. 154(b) by 122 days.

(21) Appl. No.: 14/359,567

(22) PCT Filed: Nov. 13, 2012

(86) PCT No.: PCT/EP2012/072456

§ 371 (c)(1),
(2) Date: May 20, 2014

(87) PCT Pub. No.: WO2013/079311

PCT Pub. Date: Jun. 6, 2013

(65) Prior Publication Data

US 2014/0320006 A1 Oct. 30, 2014

Related U.S. Application Data

(60) Provisional application No. 61/564,344, filed on Nov. 29, 2011.

(30) Foreign Application Priority Data

Nov. 29, 2011 (EP) ..... 11191113

(51) Int. Cl.
*H05H 13/04* (2006.01)
*H01J 25/62* (2006.01)
(Continued)

(52) U.S. Cl.
CPC ..... *H05H 7/02* (2013.01); *H05H 13/02* (2013.01); *H05H 2007/025* (2013.01)

(58) Field of Classification Search
CPC ... H05H 13/04; H05H 2007/25; H05H 13/00; H05H 13/005; H01J 25/62
USPC ..... 315/500, 501, 502, 503; 250/396 R
See application file for complete search history.

(56) References Cited

U.S. PATENT DOCUMENTS 4,904,949 A * 2/1990 Wilson ..... H05H 13/00 315/503
5,018,180 A * 5/1991 Shoulders ..... B82Y 10/00 315/500

(Continued)

OTHER PUBLICATIONS

International Search Report and Written Opinion dated Jan. 4, 2013.

(Continued)

*Primary Examiner* — Jimmy Vu
*Assistant Examiner* — Wei Chan
(74) *Attorney, Agent, or Firm* — Lowenstein Sandler LLP

(57) ABSTRACT

RF device (1) able to generate an RF acceleration voltage in a synchrocyclotron. The device comprises a resonant cavity (2) formed by a grounded conducting enclosure (5) and enveloping a conducting pillar (3) to a first end of which an accelerating electrode (4) is linked. A rotary variable capacitor (10) is mounted in the conducting enclosure at a second end of the pillar, opposite from the first end, comprising at least one fixed electrode (stator) (11) and a rotor (13) exhibiting a rotation shaft (14) supported and guided in rotation by galvanically isolating bearings (20), said rotor (13) comprising one moveable electrode (12) possibly facing the stator (11). When the shaft (14) rotates, the stator and the moveable electrode together form a variable capacitance whose value varies cyclically with time. The rotor (13) is galvanically isolated from the conducting enclosure (5) and from the pillar (3). The stator (11) is connected to the second end of the pillar (3) or to the conducting enclosure (5). The rotor is respectively coupled capacitively to the conducting enclosure or to the pillar. This makes it possible to dispense with sliding electrical contacts between the rotor and respectively the conducting enclosure or the pillar.

16 Claims, 5 Drawing Sheets

(51) Int. Cl.
*H05H 7/02* (2006.01)
*H05H 13/02* (2006.01)

(56) References Cited

U.S. PATENT DOCUMENTS 5,123,039 A * 6/1992 Shoulders ..... H01J 3/00 313/131 A
7,943,913 B2 * 5/2011 Balakin ..... H01J 3/04 250/423 R
2006/0169979 A1 * 8/2006 Endo ..... G09G 3/3233 257/59
2008/0233723 A1 * 9/2008 Okumura ..... H01J 37/32091 438/513
2009/0140671 A1 * 6/2009 O'Neal, III ..... H05H 13/02 315/502
2010/0108567 A1 * 5/2010 Medoff ..... C10G 3/00 208/49

OTHER PUBLICATIONS

Mints et al: "Radio-Frequency System for the 680 MeV Proton Synchrocyclotron", 1st International Conference on High Energy Accelerators, vol. CERN 56-26, Jun. 11, 1956, pp. 419-424.
Schneider R. et al: "Nevis Synchrocyclotron Conversion Program—R.F. System", IEEE Transactions on Nuclear Science, IEEE Service Center, New York, NY, US, vol. ns16, No. 3, Jun. 1, 1969, pp. 430-433.
A. Garonna: "Synchrocyclotron Preliminary Design for a Dual Hadrontherapy Center", IPAC'10, May 2010, pp. 552-554.

* cited by examiner

RF DEVICE FOR SYNCHROCYCLOTRON

CROSS-REFERENCE TO RELATED APPLICATIONS

This application is a national stage entry under 35 U.S.C. §371 of International Application No. PCT/EP2012/072456, filed Nov. 13, 2012, which claims the benefit of priority of European Application No. 11191113.7, filed Nov. 29, 2011, and U.S. Provisional Patent Application No. 61/564,344, filed Nov. 29, 2011, the disclosures of which are hereby incorporated by reference herein in their entirety.

FIELD OF THE INVENTION

The present invention pertains to the field of radiofrequency (RF) resonators for synchrocyclotrons, and in particular to an RF device able to generate a voltage for accelerating charged particles in a synchrocyclotron, the RF device including a resonant cavity comprising:

- a conducting pillar of which a first end is linked to an accelerating electrode adapted to accelerate said particles,
- a conducting enclosure surrounding the conducting pillar,
- a rotary variable capacitor mounted in the conducting enclosure and comprising on the one hand at least one fixed electrode linked galvanically to a second end of the conducting pillar, the second end being opposite from the first end, and on the other hand a rotor comprising at least one moveable electrode, the at least one fixed electrode and the at least one moveable electrode together forming a variable capacitance able to cause a resonant frequency of the cavity to vary over time, the rotor being galvanically isolated from the conducting enclosure and from the conducting pillar, and the rotor being coupled capacitively to the conducting enclosure;
- at least one bearing for supporting and guiding, in rotation, a shaft of the rotor, each of said bearings comprising a first race and comprising a second race fixed to the shaft of the rotor.

The invention also pertains to a synchrocyclotron comprising such an RF device.

BACKGROUND OF THE INVENTION

One type of accelerator allowing the acceleration of high-energy particles is the cyclotron. The cyclotron accelerates charged particles—for example protons—moving in an axial magnetic field and along a spiral trajectory, by applying a radiofrequency alternating voltage (also called an RF voltage) to one or more acceleration electrodes (sometimes also called "dees") contained in a vacuum chamber. This RF voltage produces an accelerating electric field in the space which separates the dees, thereby making it possible to accelerate the charged particles.

As the particles accelerate, their mass increases because of the relativistic effects. Accelerated in a uniform magnetic field, the particles therefore shift progressively out of phase with respect to the radiofrequency accelerating electric field.

In practice, two techniques are used to compensate for this phase shift: the isochronous cyclotron and the synchrocyclotron.

In a synchrocyclotron, the intensity of the magnetic field decreases slightly with radius so as to ensure correct focusing of the beam, and the frequency of the RF voltage is progressively decreased so as to compensate for the relativistic gain in mass of the accelerated particles as the radius of their trajectory increases. In this case, the frequency of the RF voltage must therefore be modulated cyclically over time: it must decrease in a constant manner during an acceleration phase between the capture and the extraction of a packet of particles, and then it must increase rapidly so as to be able to accelerate the next packet, and so on and so forth in a cyclic manner for each packet of particles.

The RF device of a synchrocyclotron thus typically comprises an accelerating electrode linked by a transmission line to a variable capacitor (sometimes also called a "RotCo"). This assembly forms a resonating RLC circuit, whose resonant frequency will vary as a function of the value of the variable capacitor. This type of variable capacitor typically comprises a rotor having moveable electrodes and a stator having fixed electrodes. When the rotor is set rotating, the moveable electrodes position themselves in a cyclic manner facing the fixed electrodes, thereby producing a cyclic variation of the capacitance as a function of time.

Such RF devices are for example known from patents GB655271 and WO2009073480 which fairly briefly disclose a Rotco.

K. A. Bajcher et al. of the Joint Institute for Nuclear Research in Dubna have pondered various problems related to this known design of Rotcos (K. A. Bajcher, V. I. Danilov, I. B. Enchevich, B. N. Marchenko, I. Kh. Nozdrin and G. I. Selivanov: Improvement in the operational reliability of the 680 MeV synchrocyclotron as a result of the modernisation of its RF system, Report 9-6218, Dubna, 1972).

One of the problems that they mention is the degradation of the sliding electrical contacts between the rotor and the conducting enclosure, possibly leading to poor operation, or indeed to a complete breakdown of the RF device. Another problem, which is in fact one of the consequences of the degradation of these contacts, is the degradation by electrocorrosion of the bearings which support and guide, in rotation, the shaft of the rotor.

Mints et al., in "Radio-frequency system for the 680 MEV proton synchrocyclotron" (Institute for Nuclear Research, USSR, page 423, FIGS. 4 and 5) proposes an RF device in which an additional coaxial capacitor (reference 5) is placed electrically in parallel with the bearings so as to reduce the RF currents passing through said bearings. Each bearing is moreover protected by a bronze sliding contact between a fixed part and a moveable part of the bearing. These bearings nonetheless continuing to be traversed by high RF currents, this does not satisfactorily solve the problems mentioned hereinabove.

These problems are accentuated by the fact that the RF devices for synchrocyclotrons which are undergoing development are of higher power and that their Rotcos will have to be capable of conducting RF currents of possibly up to for example 1000 A, under voltages of possibly up to for example 18000 V. The rotor will also revolve at higher speeds of possibly up to for example 7000 revolutions per minute.

These problems are moreover still topical, as attested more recently by A. Garonna in his paper "Synchrocyclotron preliminary design for a dual hardontherapy center" (MOPEC 042, conference IPAC'10—May 2010—Kyoto Japan, page 554 "frequency modulation"—second paragraph). It is proposed therein to remedy the problems mentioned by utilizing electronic modulation of the RF frequency.

SUMMARY OF THE INVENTION

An aim of the invention is to provide an RF device which at least partially solves the problems of the known devices. In particular, an aim of the invention is to provide an RF device which is more reliable and/or more durable than the known devices.

For this purpose, the RF device according to the invention is characterized in that each of said bearings is a galvanically isolating bearing.

The expressions "galvanically isolating bearing" or "isolated bearing" should be understood to mean:

- either a magnetic bearing, that is to say a bearing whose first and second race are held apart by a magnetic field, so that they are not in physical contact one with the other,
- or a bearing of which at least one of the parts out of its first race, its second race, and the set of its rolling elements situated between its first race and its second race, is made from an electrically insulating material.

Indeed, the combination of the capacitive coupling of the rotor with the enclosure and with the pillar on the one hand and of the galvanic isolation provided by the bearings on the other hand, makes it possible to dispense with sliding electrical contacts between the rotor and the enclosure or the pillar so as to link them electrically, while allowing the variable capacitor to fulfil its function, that is to say to vary the resonant frequency of the cavity over time. In addition to the increase in reliability and/or in durability of the assembly that this affords, this solution contributes to reducing the cost and optionally the bulkiness of the device since it is possible to dispense with the sliding contacts. Maintenance of the device will also be reduced.

Preferably, the bearings are magnetic bearings.

According to a preferred alternative, each of the bearings comprises rolling elements between its first race and its second race, and at least one of the parts of each of the bearings out of its first race, its second race and the set of its rolling elements is made from an electrically insulating material, preferably a ceramic material, in a more preferred manner silicon nitride.

In each of these two preferred versions of the device according to the invention, the desired galvanic isolation is thus obtained, while providing a mechanical solution capable of addressing the mechanical constraints imposed by the operation of the device (such as the high rotation speed of the rotor, for example speeds of greater than 5000 revolutions per minute).

BRIEF DESCRIPTION OF THE FIGURES

These aspects as well as other aspects of the invention will be clarified in the detailed description of particular embodiments of the invention, reference being made to the drawings of the figures, in which.

The drawings of the figures are neither to scale, nor proportioned. Generally, similar elements are denoted by similar references in the figures.

DETAILED DESCRIPTION OF PARTICULAR EMBODIMENTS

Figure 1:
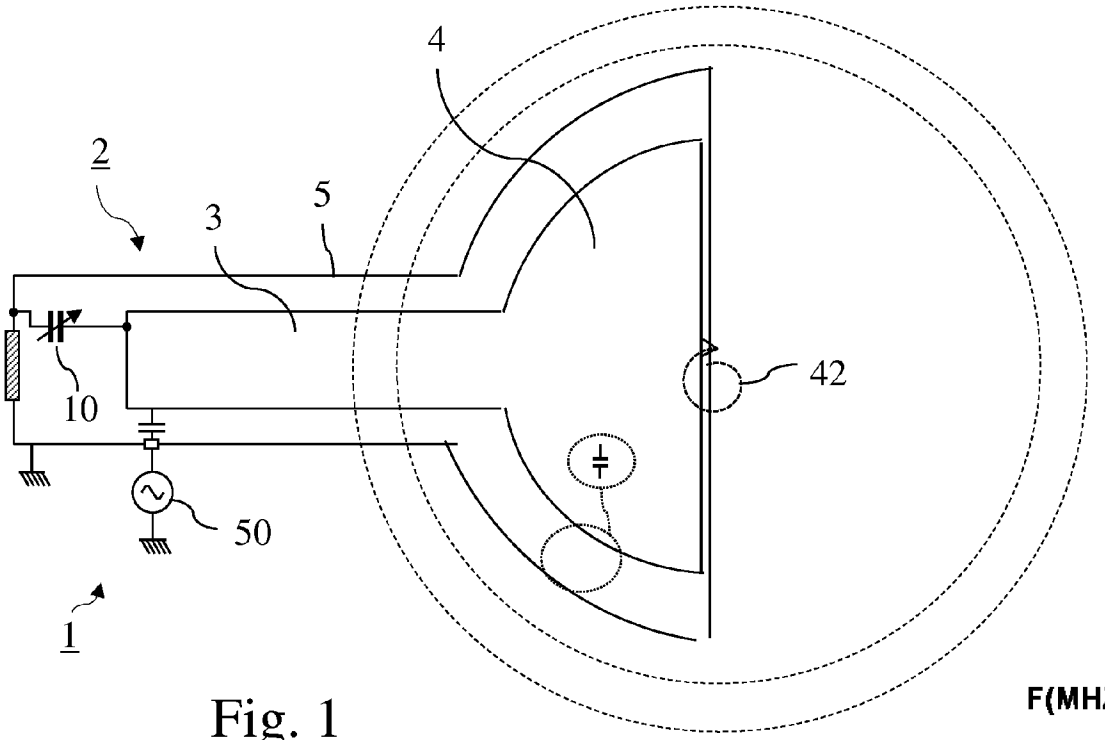
FIG. 1 shows in a schematic manner an RF device of a synchrocyclotron.

In order to show firstly briefly the known setting within which the invention lies, FIG. 1 represents in a schematic manner an RF device of a synchrocyclotron. This RF device (1) includes a resonant cavity (2) comprising:

- a conducting pillar (3) of which a first end is linked to an accelerating electrode (4) which will generate, when operating, an electric field so as to accelerate charged particles whose trajectory (42) in the synchrocyclotron is indicated by a dashed line in the figure,
- a conducting enclosure (5) surrounding the pillar (3),
- a rotary variable capacitor (10) (here represented by its electrical symbol) mounted in the conducting enclosure and comprising on the one hand at least one fixed electrode galvanically linked (for example welded or screwed) to a second end of the conducting pillar, the second end being opposite from the first end, and on the other hand a rotor comprising at least one moveable electrode linked electrically to the conducting enclosure, the at least one fixed electrode and the at least one moveable electrode together forming a variable capacitance able to cause a resonant frequency of the cavity to vary over time. Note that—within the framework of the present invention—the term "RF" should be understood to mean a Radio-Frequency, that is to say a frequency lying between 3 KHz and 300 GHz. In a synchrocyclotron, the RF frequency typically varies cyclically over time between 10 MHz and 200 MHz, for example between 59 MHz and 88 MHz.

Figure 2:
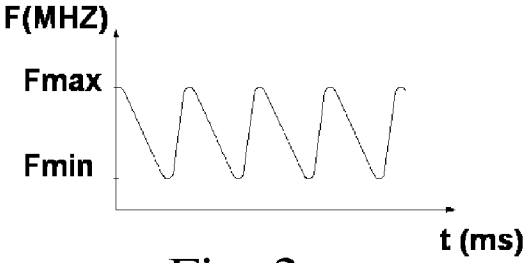
FIG. 2 shows an example of the variation of the resonant frequency of the RF device of FIG. 1 over time.

To feed the cavity (2) with energy, an RF generator (50) is used, which may for example be coupled capacitively to the pillar (3). In the case illustrated, a pole of the generator as well as the conducting enclosure are electrically grounded. FIG. 2 shows an example of the variation of the resonant frequency of the RF device of FIG. 1 over time when the RF device is energized and when the variable capacitor is rotating.

Such a device being known, it will not be described in greater detail here. We describe subsequently in greater detail the part of the RF device wherein the invention is more particularly involved, namely the left part of the device illustrated in FIG. 1, that is to say the part which comprises the Rotco.

Figure 3C:
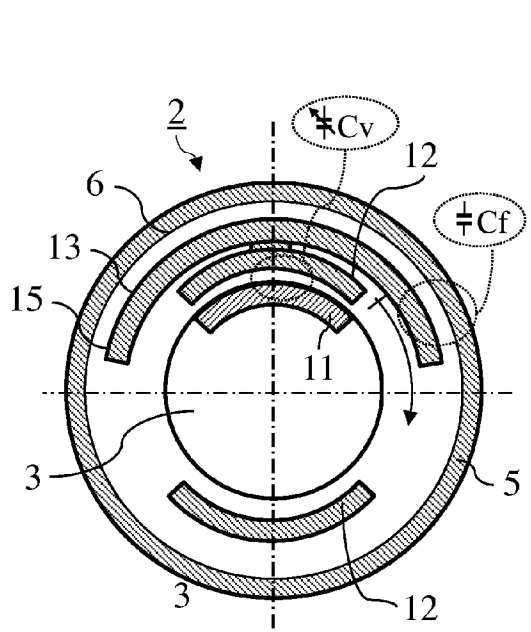
FIG. 3*c* shows a transverse section through an RF device according to an execution variant.
Figure 3B:
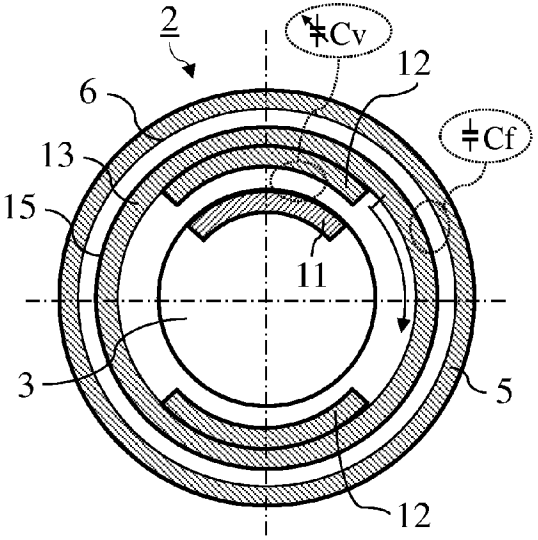
FIG. 3*b* shows a transverse section on the plane AA of the RF device of FIG. 3*a;*
Figure 3A:
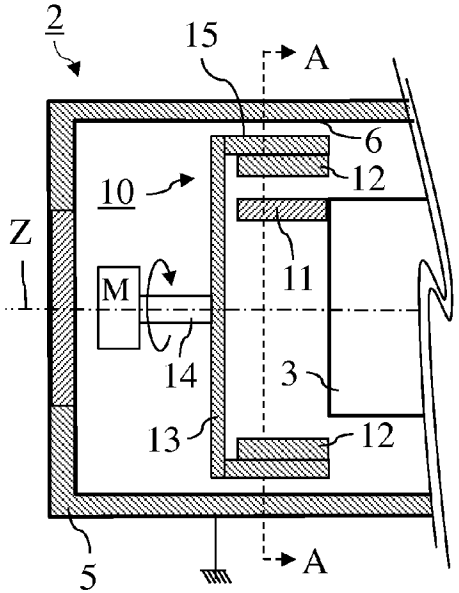
FIG. 3*a* shows in a schematic manner a partial longitudinal section through an exemplary embodiment of an RF device according to the invention.

FIGS. 3*a* and 3*b* show—in a schematic manner—respectively a partial longitudinal section and a section along the plane AA of an exemplary embodiment of an RF device according to the invention.

Depicted therein is a rotary variable capacitor (10) mounted in the conducting enclosure (5) and comprising, on the one hand at least one fixed electrode (11) linked galvanically (for example welded or screwed) to the second end of the conducting pillar (3), and on the other hand a rotor (13) comprising at least one moveable electrode (12).

The rotor (13) is furnished with a shaft (14) with axis (Z) that can be driven by a motor (M) so as to set the rotor rotating. FIG. 3*b* demonstrates that the at least one fixed electrode (11) and the at least one moveable electrode (12) together form a capacitance (Cv) varying cyclically over time when the rotor (13) is set rotating about its axis (Z).

The rotor (13) is galvanically isolated from the conducting enclosure (5) and from the conducting pillar (3), that is to say there is no galvanic link between the rotor (and therefore the at least one moveable electrode) on the one hand and the conducting enclosure and/or the pillar on the other hand. Means for achieving this galvanic isolation will be detailed hereinafter.

In this exemplary embodiment, a conducting exterior surface (15) of the rotor (13) is of axisymmetric cylindrical shape with axis Z, and an interior surface (6) of at least one longitudinal section of the enclosure (5) being situated at the level of said exterior surface of the rotor is also of axisymmetric cylindrical shape with axis Z. As is seen better in FIG. 3*b*, these two coaxial cylindrical surfaces (6, 15) together produce a constant capacitance (Cf), that is to say a capacitance whose value remains substantially constant over time, including when the rotor is set rotating. These two cylindrical surfaces (6, 15) will be dimensioned and positioned with respect to one another so that the capacitance (Cf) has for example a value lying between 0.1 nanofarads and 10 nanofarads, preferably between 1 nanofarad and 4 nanofarads, this being so when the variable capacitance (Cv) is cyclically variable between a minimum value of 65 picofarads and a maximum value of 270 picofarads for example. The choice of these preferred values indeed makes it possible to obtain a total capacitance (resulting from the series arrangement of Cv and Cf) which will be able to vary between a maximum value and a minimum value that are satisfactory for a synchrocyclotron. It is indeed sought to maximize the ratio of the maximum value to the minimum value of this total capacitance, whilst maximizing the value of Cf so as in particular to reduce the voltage across its terminals but while taking account of the fact that there are practical limits to the distance that can separate the exterior surface of the rotor from the interior surface of the enclosure. It is also sought to limit the size of the rotor for reasons of bulk and weight.

Note that with these values of Cf and Cv, relatively high voltages may occur between the shaft of the rotor and the conducting enclosure when the device is operating (up to 1500 V for a maximum voltage of 18000 V between the pillar and the enclosure for example).

The moveable electrode or electrodes (12) of the rotor are of course linked galvanically together and to said conducting exterior surface (15) of the rotor. For this purpose, the rotor (comprising the moveable electrodes) is for example made entirely of one or more electrically conducting materials. The fixed electrode or electrodes (11) are of course linked galvanically together and to the second end of the pillar (3).

Capacitive coupling between the rotor (13) and the conducting enclosure (5) is thus obtained.

It should be noted that the capacitance Cf need not necessarily exhibit a constant value over time; it would also be possible to design a rotco in such a way that this capacitance Cf exhibits a value varying over time, for example a value varying cyclically over time. It would suffice for this purpose to provide for example protuberances on the interior surface of the enclosure as well as corresponding protuberances on the exterior surface of the rotor. However, it is preferable that the value of Cf be constant over time.

It will moreover be obvious that many other configurations are possible in order to achieve said capacitance Cf. FIG. 3*c* shows for example a transverse section through an RF device according to a possible variant embodiment in which the exterior surface (15) of the rotor (13) forms a partial cylinder, whilst forming—with the interior surface (6) of the enclosure—a capacitance (Cf) of constant value over time. The configuration of FIG. 3*b* is however preferred for reasons of mechanical balancing and maximization of the capacitance (Cf).

Figure 4:
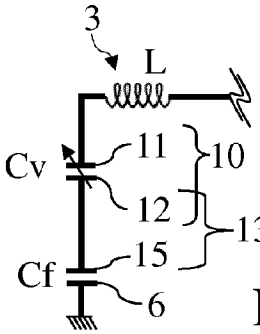
FIG. 4 shows a partial equivalent circuit of the RF device of FIG. 3*a;*

By arranging the capacitance Cv and the capacitance Cf in series, a cyclically time-varying capacitance is thus achieved globally between the second end of the pillar (3) and the conducting enclosure (5), as illustrated in FIG. 4 which represents a partial equivalent circuit of the RF device, in which "L" represents an inductance of the pillar, "Cr" represents the capacitance between the rotor (therefore the moveable electrode or electrodes) and the conducting enclosure, and "Cv" represents the variable capacitance between the fixed electrode or electrodes (11) and the moveable electrode or electrodes (12).

Various means may be used to isolate galvanically the rotor (13) from the conducting enclosure (5) and from the conducting pillar (3).

A first means consists in making the rotor shaft (14) from an insulating material, for example a shaft made of ceramic or carbon fibre or of any other material made of insulating fibres and in mounting this shaft on bearings which are fixed to the enclosure or to the pillar. Although these solutions are suitable, they exhibit the drawback that ceramic is relatively brittle and that the fibre materials may not exhibit sufficient mechanical strength when the rotor revolves at high speed (for example at more than 5000 revolutions per minute).

We will describe hereinafter the preferred ways of achieving said galvanic isolation.

Figure 5:
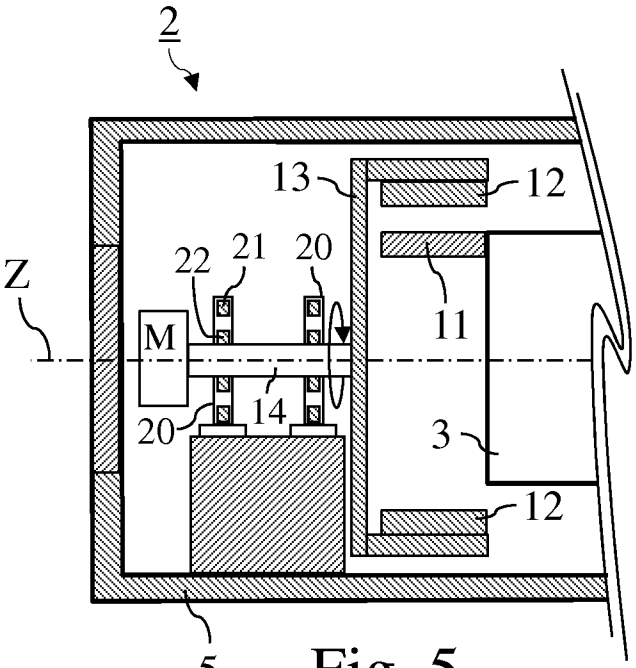
FIG. 5 shows in a schematic manner a partial longitudinal section through a preferred exemplary embodiment of an RF device according to the invention.

FIG. 5 shows in a schematic manner a partial longitudinal section through a preferred exemplary embodiment of an RF device according to the invention. The shaft (14) of the rotor is mounted on two magnetic bearings (20), several models of which exist on the market. Each magnetic bearing (20) comprises a first race (21) that is fixed and a second race (22) that can move with respect to the first race. The shaft (14) of the rotor is mounted through the second race (22) held radially in magnetic suspension with respect to the first race (21).

Galvanic isolation is thus obtained between the rotor and the conducting enclosure (5) as well as between the rotor and the pillar (3).

Figure 6:
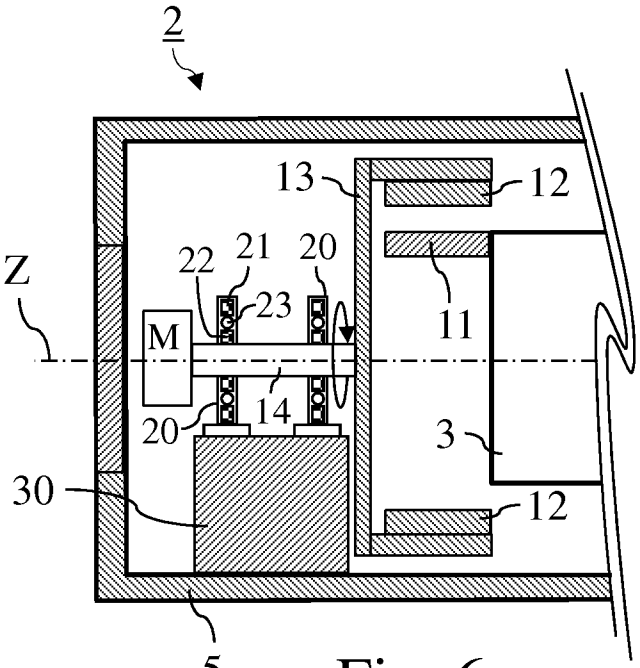
FIG. 6 shows in a schematic manner a partial longitudinal section through a preferred exemplary embodiment according to an alternative of an RF device according to the invention.

Magnetic bearings such as these being relatively expensive at present, there is proposed an alternative such as illustrated in FIG. 6.

Here, each of the bearings (20) comprises a first race (21) mounted fixedly, a second race (22) moveable with respect to the first race and fixed to the shaft (14) of the rotor (13), and rolling elements (23) mounted rolling between the first race and the second race. At least one of the parts of each of the bearings out of its first race (21), its second race (22) and the set of its rolling elements (23) is made from an electrically insulating material. Galvanic isolation is thus obtained between the rotor and the conducting enclosure (5) as well as between the rotor and the pillar (3).

Preferably said electrically insulating material is a ceramic material since ceramic offers both good galvanic isolation and good mechanical strength. In a more preferred manner, the electrically insulating material is silicon nitride (Si3N4).

Preferably each rolling element is made of the electrically insulating material. It is thus proposed to use bearings at least all of whose rolling elements (for example balls and/or rollers and/or needles) are made of ceramic, preferably silicon nitride.

Figure 7:
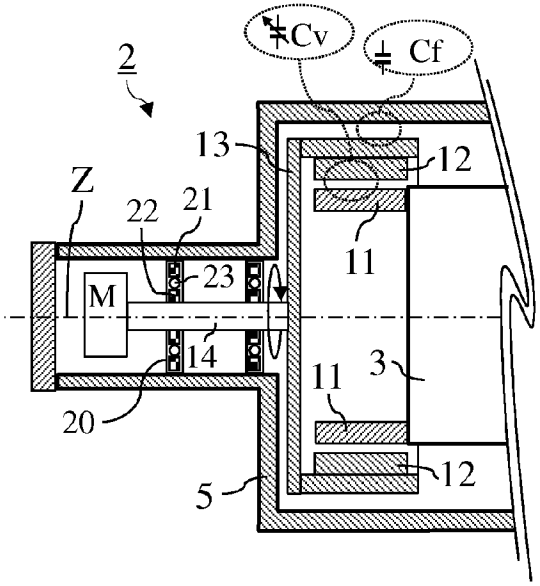
FIG. 7 shows in a schematic manner a partial longitudinal section through a more preferred exemplary embodiment of an RF device according to the invention.

The first race (21) of each bearing is preferably fixed directly to the conducting enclosure, as illustrated schematically in the example of FIG. 7. This makes it possible in particular to dispense with a distinct support between the bearing on the one hand and the conducting enclosure on the other hand. Alternatively, the first race of each bearing is fixed directly to the pillar (3) (not illustrated). Alternatively, the first race of at least one bearing is fixed directly to the pillar (3) and the first race of at least one other bearing is fixed directly to the conducting enclosure (not illustrated).

The invention also pertains to a device reversed with respect to those described hereinabove, that is to say an RF device such as described hereinabove, but in which the at least one fixed electrode (11) is linked galvanically to the conducting enclosure (5) and in which the rotor (13) is coupled capacitively to the second end of the pillar (3).

Figure 8C:
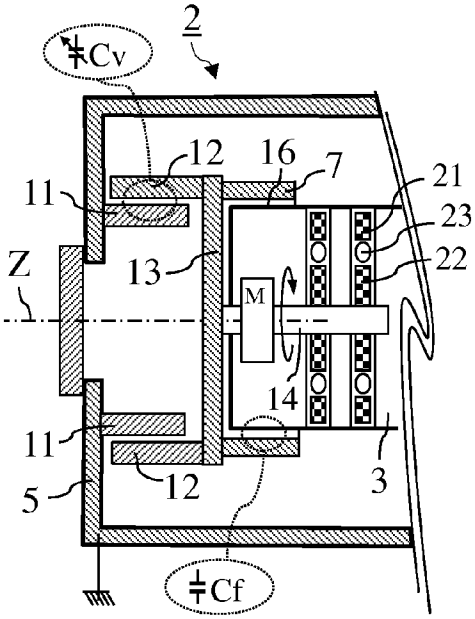
FIG. 8*c* shows in a schematic manner a partial longitudinal section through an alternative exemplary embodiment of an RF device according to the invention.
Figure 8A:
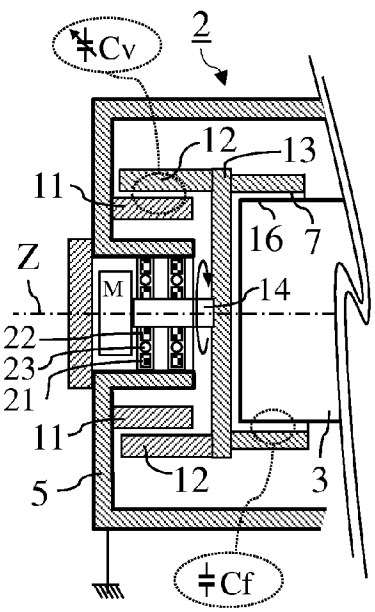
FIG. 8*a* shows in a schematic manner a partial longitudinal section through an alternative exemplary embodiment of an RF device according to the invention.

FIG. 8*a* shows in a schematic manner a partial longitudinal section through an exemplary embodiment of a reversed RF device such as this. As seen in FIG. 8*a*, the rotor (13) comprises a cylindrical part with axis (Z) at least partially surrounding the second cylindrical end of the pillar with axis (Z) also. The interior face (7) of this cylindrical part of the rotor and the exterior face (16) of this second cylindrical part of the pillar thus form, at this location, two coaxial cylinders exhibiting a capacitance of constant value (Cf), thus achieving capacitive coupling between the second end of the pillar and the rotor. The variable capacitance (Cv) is here formed by at least one moveable electrode (12) of the rotor and by at least one fixed electrode (11) linked galvanically to the conducting enclosure (5).

Alternatively, provision may of course be made for said cylindrical part of the rotor to be surrounded by said second cylindrical end of the pillar, for example in the case where the pillar is hollow at its second end.

Figure 8B:
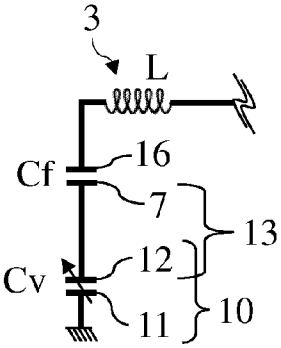
FIG. 8*b* shows a partial equivalent circuit of the RF device of FIG. 8*a;*

By arranging the capacitance Cv and the capacitance Cf in series, a capacitance varying cyclically over time is thus achieved globally between the second end of the pillar (3) and the conducting enclosure (5), as illustrated in FIG. 8*b* which shows a partial equivalent circuit of the RF device of FIG. 8*a*, in which "L" represents an inductance of the pillar.

In this reversed variant, the rotor is obviously also galvanically isolated from the conducting enclosure (5) and from the pillar (3), for example by means like those described hereinabove, including the galvanically isolating bearings (20). In FIG. 8*a*, the galvanic isolation is for example obtained by the same means as those described in conjunction with FIG. 7. FIG. 8*c* shows for example a case identical to the case of FIG. 8*a* but in which the shaft (14) of the rotor is supported and guided in rotation by isolated bearings mounted directly inside the pillar.

Figure 9:
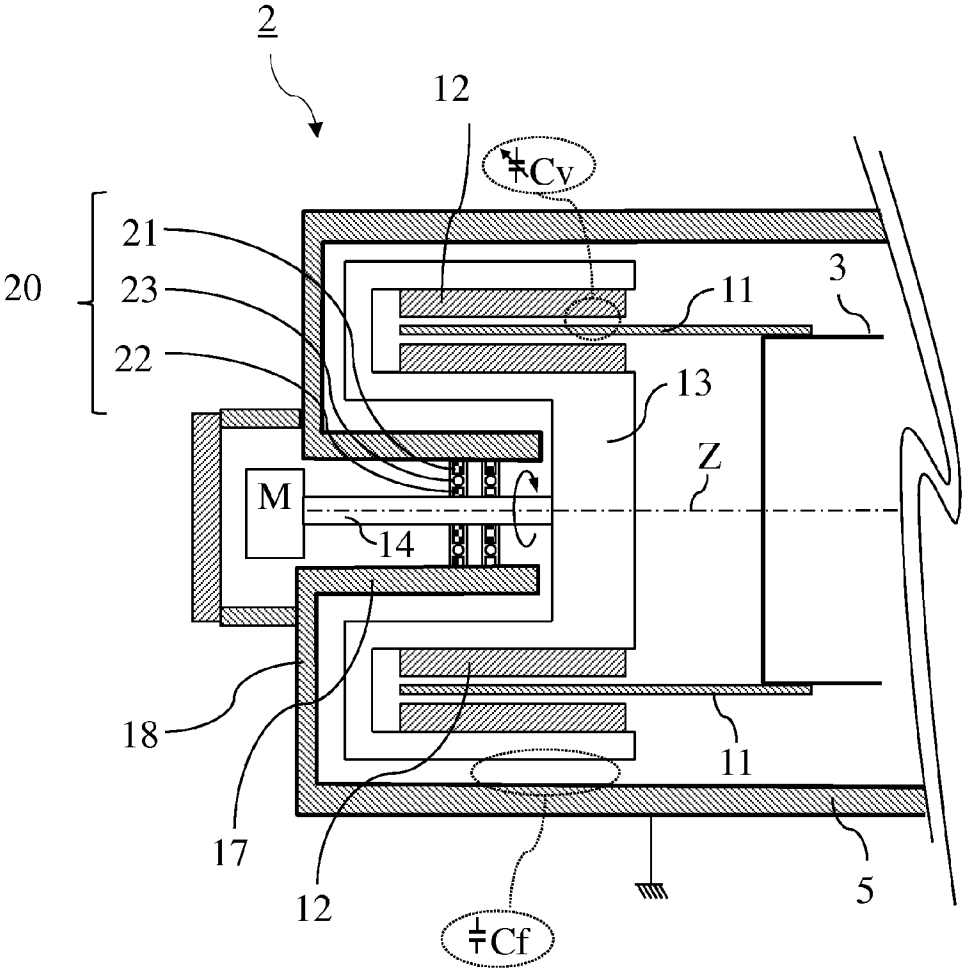
FIG. 9 shows in a schematic manner a partial longitudinal section through a still more preferred exemplary embodiment of an RF device according to the invention.

Preferably, the RF device comprises a rotary variable capacitor such as described in the document WO2012/101143 and incorporated here by reference. A rotary variable capacitor such as this is schematically represented in FIG. 9. The rotary variable capacitor comprises a rotor (13) of which a longitudinal section is W-shaped, a shaft (14) linking a central part of the rotor to a motor (M), and at least one isolated bearing (20) such as described hereinabove and comprising a first race (21), a second race (22) and rolling elements (23) between the first and the second race. A tubular portion (17) extends from the lateral wall (18) of the conducting enclosure (5) towards the interior of the conducting enclosure (5) so as to penetrate into a central hollow portion of the W-shaped rotor. The first race (21) is fixed to the interior wall of the tubular portion (17), the second race (22) is fixed on the shaft (14). This geometry has the advantage of allowing the positioning of the bearing (20) in proximity to the centre of mass of the rotor (13), and of preventing the rotor (13) from being cantilevered with respect to the bearing. The position of the rotor (13) is thus stabilized and the rotation of the rotor can be performed at much greater speeds with less risk of deformation of the shaft (14) and of collision between the rotor (13) and the fixed electrodes (11) and/or with the conducting enclosure (5). This results in a possibility of reducing the distance between the fixed electrodes (11) and the moveable electrodes (12) of the rotor (13), thereby making it possible to increase the fixed capacitance and/or the variable capacitance. For example the distance between the fixed electrodes (11) and the moveable electrodes (12) of the rotor, as well as the distance between the distal walls of the rotor (13) and the internal walls of the conducting enclosure may lie between 0.8 mm and 5 mm, preferably between 0.8 mm and 1.5 mm. Preferably, the space between the external wall of the tubular portion and the internal wall of the central hollow portion of the W-shaped rotor and also lying between 0.8 mm and 5 mm, preferably lying between 0.8 mm and 1.5 mm, this also makes it possible to increase the fixed capacitance between the rotor and the conducting enclosure. The motor may be positioned inside the tubular portion (17) or outside this tubular portion. Preferably, the motor is situated in the conducting enclosure (5) and in proximity to the lateral wall (18) of the conducting enclosure.

The present invention has been described in conjunction with specific embodiments, which have a purely illustrative value and must not be considered to be limiting. In a general way, it will be obviously apparent to the person skilled in the art that the present invention is not limited to the examples illustrated and/or described hereinabove.

The presence of reference numbers in the drawings cannot be considered to be limiting, including when these numbers are indicated in the claims.

The use of the verbs "comprise", "include", or any other variant, as well as their conjugations, cannot in any way exclude the presence of elements other than those mentioned. The use of the indefinite article "a", "an", or of the definite article "the", to introduce an element does not exclude the presence of a plurality of these elements.

The invention can also be described as follows: an RF device (1) able to generate an RF acceleration voltage whose frequency varies cyclically with time so as to accelerate charged particles in a synchrocyclotron. The device comprises a resonant cavity (2) formed by a grounded conducting enclosure (5) and enveloping a conducting pillar (3) to a first end of which an accelerating electrode (4) is linked. A rotary variable capacitor (10) is mounted in the conducting enclosure at the level of a second end of the pillar, opposite from the first end, and comprises at least one fixed electrode (11) as well as a rotor (13) exhibiting a rotation shaft (14) supported and guided in rotation by galvanically isolating bearings (20), said rotor (13) being furnished with at least one moveable electrode (12) that may possibly be facing the at least one fixed electrode (11). When the shaft (14) is set rotating, the at least one fixed electrode and the at least one moveable electrode together form a variable capacitance whose value varies cyclically with time. The rotor (13) is galvanically isolated from the conducting enclosure (5) and from the pillar (3). The fixed electrode (11) is connected to the second end of the pillar (3) or to the conducting enclosure (5). The rotor is respectively coupled capacitively to the conducting enclosure or to the pillar (3) by a capacitance (Cf) whose first electrode is preferably an exterior surface (15) of the rotor and whose second electrode is preferably respectively an interior surface (6) of the conducting enclosure or an interior or exterior surface of the pillar. This makes it possible to dispense with sliding electrical contacts between the rotor and respectively the conducting enclosure or the pillar.

The invention also relates to a synchrocyclotron comprising an RF device such as described hereinabove.

What is claimed is:

1. An RF device able to generate a voltage for accelerating charged particles in a synchrocyclotron, the RF device including a resonant cavity comprising:

a conducting pillar of which a first end is linked to an accelerating electrode adapted to accelerate said particles;

a conducting enclosure surrounding the conducting pillar;

a rotary variable capacitor mounted in the conducting enclosure and comprising on the one hand at least one fixed electrode linked galvanically to a second end of the conducting pillar, the second end being opposite from the first end, and on the other hand a rotor comprising at least one moveable electrode, the at least one fixed electrode and the at least one moveable electrode together forming a variable capacitance (Cv) able to cause a resonant frequency of the cavity to vary over time, the rotor being galvanically isolated from the conducting enclosure and from the conducting pillar, and the rotor being coupled capacitively to the conducting enclosure; and at least one bearing for supporting and guiding, in rotation, a shaft of the rotor, each of said bearings comprising a first race and a second race fixed to the shaft of the rotor;

wherein each of said bearings is a galvanically isolating bearing.

2. The RF device of claim 1, wherein the bearings are magnetic bearings.

3. The RF device of claim 1, wherein each of the bearings comprises rolling elements between its first race and its second race, and in that at least one of the parts of each of the bearings out of its first race, its second race and the set of its rolling elements is made from an electrically insulating material.

4. The RF device of claim 3, wherein said electrically insulating material is a ceramic material.

5. The RF device of claim 3, wherein each rolling element is made of the electrically insulating material.

6. The RF device of claim 5, wherein said electrically insulating material is a ceramic material.

7. The RF device as claimed in claim 1, wherein the first race is fixed directly to the conducting enclosure or to the pillar.

8. The RF device of claim 1, wherein the synchrocyclotron comprises the RF device.

9. An RF device able to generate a voltage for accelerating charged particles in a synchrocyclotron, the RF device including a resonant cavity comprising:

a conducting pillar of which a first end is linked to an accelerating electrode so as to accelerate said particles;

a conducting enclosure surrounding the conducting pillar;

a rotary variable capacitor mounted in the conducting enclosure and comprising on the one hand at least one fixed electrode linked galvanically to the conducting enclosure, and on the other hand a rotor comprising at least one moveable electrode, the at least one fixed electrode and the at least one moveable electrode together forming a variable capacitance (Cv) able to cause a resonant frequency of the cavity to vary over time, the rotor being galvanically isolated from the conducting enclosure and from the conducting pillar, and the rotor being coupled capacitively to a second end of the conducting pillar, the second end being opposite from the first end; and at least one bearing for supporting and guiding, in rotation, a shaft of the rotor, each of said bearings comprising a first race and a second race fixed to the shaft of the rotor;

wherein each of said bearings is a galvanically isolating bearing.

10. The RF device of claim 9, wherein the bearings are magnetic bearings.

11. The RF device of claim 9, wherein each of the bearings comprises rolling elements between the first race and the second race, and in that at least one of the parts of the bearing from among the first race, the second race and the set of rolling elements is made from an electrically insulating material.

12. The RF device of claim 11, wherein said electrically insulating material is a ceramic material.

13. The RF device of claim 11, wherein each rolling element is made of the electrically insulating material.

14. The RF device of claim 13, wherein said electrically insulating material is a ceramic material.

15. The RF device of claim 9, wherein the first race is fixed directly to the conducting enclosure or to the pillar.

16. The RF device of claim 9, wherein the synchrocyclotron comprises the RF device.

* * * * *